US007988148B2

(12) United States Patent
Tanioka

(10) Patent No.: US 7,988,148 B2
(45) Date of Patent: Aug. 2, 2011

(54) TRANSPORTING PATH CONFIGURATION AND IMAGE FORMING APPARATUS

(75) Inventor: Yoshiyasu Tanioka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 93 days.

(21) Appl. No.: 12/548,867

(22) Filed: Aug. 27, 2009

(65) Prior Publication Data

US 2010/0230892 A1 Sep. 16, 2010

(30) Foreign Application Priority Data

Mar. 16, 2009 (JP) ..... 2009-062673

(51) Int. Cl.
*B65H 5/00* (2006.01)

(52) U.S. Cl. ..... 271/264; 271/273; 271/65

(58) Field of Classification Search ..... 271/264, 271/273, 274, 291, 65, 301, 186
See application file for complete search history.

(56) References Cited

U.S. PATENT DOCUMENTS 5,974,290 A * 10/1999 Inoue ..... 399/124
5,984,305 A * 11/1999 Inoue ..... 271/291
6,206,368 B1 * 3/2001 Kobayashi et al. ..... 271/273
6,332,611 B1 * 12/2001 Tomita ..... 271/273
6,598,870 B2 * 7/2003 Hanano ..... 271/138
7,515,850 B2 * 4/2009 Hasegawa ..... 399/124
7,789,388 B2 * 9/2010 Matsubara et al. ..... 271/301

FOREIGN PATENT DOCUMENTS

JP 2006-62862 3/2006
JP 2006-96541 4/2006

* cited by examiner

*Primary Examiner* — Michael C McCullough
(74) *Attorney, Agent, or Firm* — Morgan, Lewis & Bockius LLP

(57) ABSTRACT

A transporting path configuration includes: a separating mechanism that separates from one of transporting members the other transporting member; an opening/closing transporting path member that is rotatably attached above the transporting members and has one surface that configures a first transporting path of the recording medium discharged from the transporting members; a transporting path member that forms a second transporting path between the transporting path member and the other surface of the opening/closing transporting path member in a state of covering the opening/closing transporting path member; a handle that is attached to the opening/closing transporting path member so as to be extended above the second transporting path and is further extended above a cover that covers a discharge member; and a moving mechanism that moves the handle in the direction away from the cover when the other transporting member is separated from the one transporting member by the separating mechanism.

8 Claims, 8 Drawing Sheets

TRANSPORTING PATH CONFIGURATION AND IMAGE FORMING APPARATUS

CROSS-REFERENCE TO RELATED APPLICATION

This application is based on and claims priority under 35 USC 119 from Japanese Patent Application No. 2009-062673 filed on Mar. 16, 2009.

BACKGROUND

Technical Field

The present invention relates to a transporting path configuration and an image forming apparatus.

SUMMARY

A transporting path configuration according to a first aspect of the invention includes: a separating mechanism that, with respect to a pair of transporting members which nip and transport a recording medium, separates from one of the transporting members the other transporting member; an opening/closing transporting path member that is rotatably attached above the transporting members and has one surface that configures a first transporting path of the recording medium discharged from the transporting members; a transporting path member that is rotatably attached above the opening/closing transporting path member and forms a second transporting path between the transporting path member and the other surface of the opening/closing transporting path member in a state of covering the opening/closing transporting path member; a handle that is attached to the opening/closing transporting path member so as to be extended above the second transporting path and is further extended above a cover that covers a discharge member that transports the recording medium transported from the first transporting path; and a moving mechanism that moves the handle in the direction away from the cover when the other transporting member is separated from the one transporting member by the separating mechanism.

BRIEF DESCRIPTION OF THE DRAWINGS

Exemplary embodiments of the present invention will be described in detail based on the following figures, wherein.

DETAILED DESCRIPTION

A First Exemplary Embodiment

A first exemplary embodiment of an image forming apparatus to which a transporting path configuration according to the present invention is applied will be described below in detail with reference to the drawings.

Figure 1:
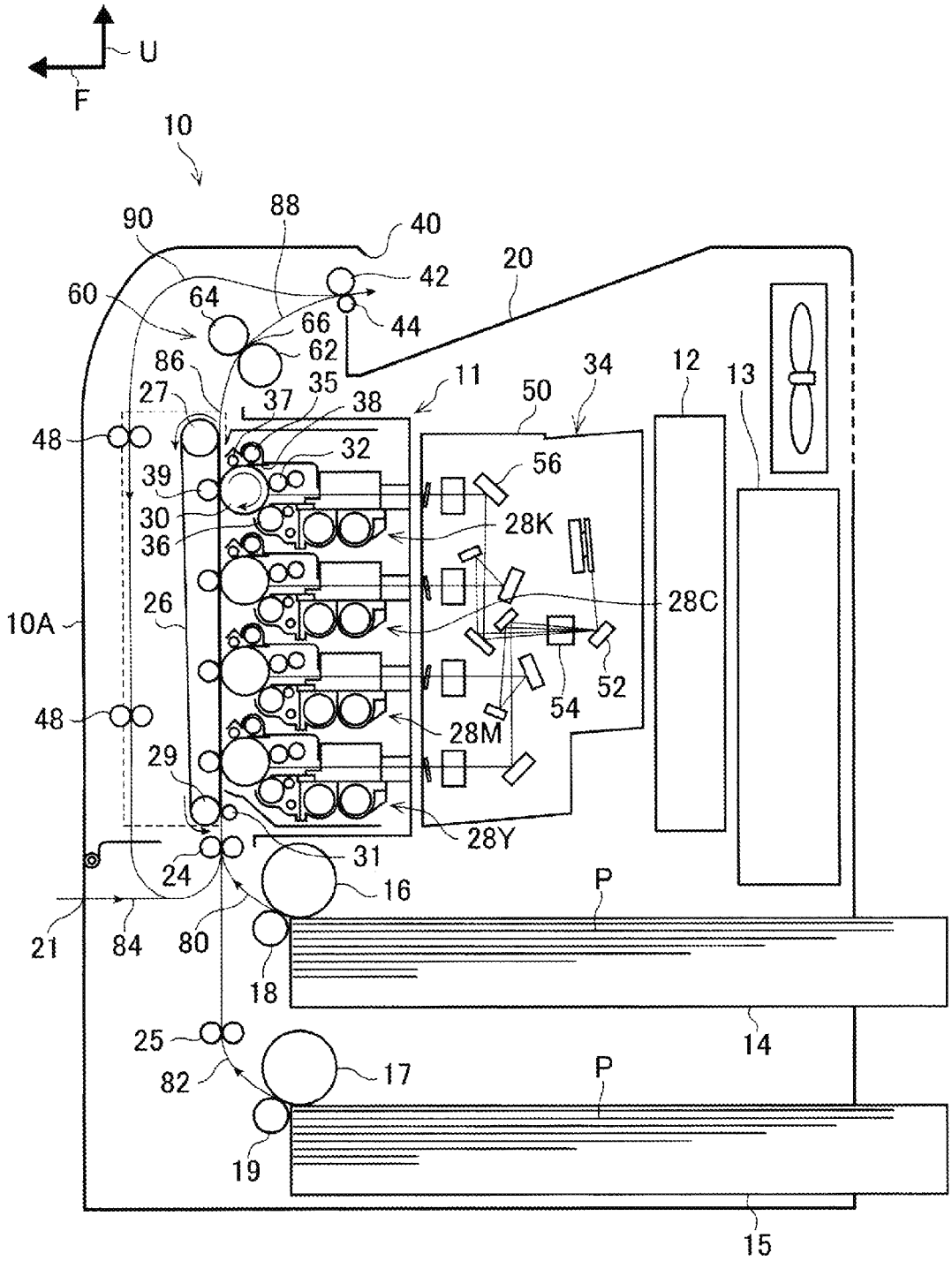
FIG. 1 is a diagram illustrating the overall configuration of an image forming apparatus of a first exemplary embodiment.

As illustrated in FIG. 1, an image forming apparatus 10 has, in a lower portion, sheet feeding trays 14 and 15 in which sheets P are stacked in a bundle and stored and, in an upper portion, a discharge section 20 on which the printed (image formed) sheets P (an example of a recording medium) discharged to the outside of the apparatus are stacked. An image forming unit 11 which forms an image on the sheet P, a controller 12 which controls an image forming operation, and a power source unit 13 are provided between the sheet feeding trays 14 and 15 and the discharge section 20. The image forming apparatus 10 also has a transporting path which guides the sheet P to each of the apparatus configuring portions and plural transporting rollers which nip and transport the sheet P. In the drawing, an arrow U indicates the up direction of the image forming apparatus 10, an arrow F indicates the front direction, and an arrow L indicates the left direction (seen from the front of the apparatus).

As illustrated in FIG. 1, the image forming apparatus 10 has a first sheet feeding transporting path 80 which is gently curved from the leading end side (in FIG. 1, the left end) of the sheet feeding tray 14 diagonally up to the left, and a second sheet feeding transporting path 82 which is gently curved from the leading end side (in FIG. 1, the left end) of the sheet feeding tray 15 diagonally up to the left. The image forming apparatus 10 has a manual feeding tray, not illustrated, on the front of the apparatus, and a third sheet feeding transporting path 84 gently curved from an inlet 21 of the manual feeding tray diagonally up to the right. The sheet feeding transporting paths are joined before (or below) a pair of registration rollers 24 provided above the sheet feeding tray 14.

A sheet feeding roller 16 is provided immediately above the leading end side of the sheet feeding tray 14 so as to be pressed into contact with the leading edge of the upper side of the sheet P. A separating roller 18 pressed into contact with the sheet feeding roller 16 is provided leftwardly of the sheet feeding roller 16. The sheet feeding roller 16 picks up the uppermost sheet P of the sheet feeding tray 14 and then feeds the sheet P to the first sheet feeding transporting path 80 through between the sheet feeding roller 16 and the separating roller 18. The separating roller 18 loosens (or separates) plural sheets P picked up by the sheet feeding roller 16.

Similarly, a sheet feeding roller 17 is provided immediately above the leading end side of the sheet feeding tray 15 so as to be pressed into contact with the leading edge of the upper surface of the sheet P. A separating roller 19 pressed into contact with the sheet feeding roller 17 is provided leftwardly of the sheet feeding roller 17. The sheet feeding roller 17 picks up the uppermost sheet P of the sheet feeding tray 15 and then feeds the sheet P to the second sheet feeding transporting path 82 through between the sheet feeding roller 17 and the separating roller 19. The separating roller 19 loosens (or separates) the plural sheets P picked up by the sheet feeding roller 17.

A pair of registration rollers 25 are provided on the second sheet feeding transporting path 82. The registration rollers 25 nip and transport the sheet P transported to the second sheet feeding transporting path 82 to the registration rollers 24.

The image forming apparatus 10 has an image forming transporting path 86 extended upward from the registration rollers 24 toward a later-described fixing device 60 of the image forming unit 11. An endless transporting belt 26 which electrostatically absorbs the sheet P and transports the sheet P to the fixing device 60 is arranged on the image forming transporting path 86.

The transporting belt 26 is entrained around an entraining roller 27 arranged above and an entraining roller 29 arranged below. Either of the entraining rollers 27 and 29 is rotationally driven in a predetermined direction (in FIG. 1, counterclockwise) to rotate (circulatively drive) the transporting belt 26 in a predetermined direction (in FIG. 1, counterclockwise).

A charging roller 31 is provided adjacent to the transporting belt 26 on the upstream side of the image forming transporting path 86 of the transporting belt 26 (simply called an "upstream side"). The charging roller 31 charges the surface of the transporting belt 26 and presses the sheet P electrostatically absorbed onto the transporting belt 26 onto the transporting belt 26.

Plural process cartridges 28Y, 28M, 28C, and 28K corresponding to yellow, magenta, cyan, and black colors are longitudinally arranged in a substantially vertical direction along the image forming transporting path 86 at portions facing the transporting belt 26 with the transporting path 86 therebetween. The image forming unit 11 includes the process cartridges 28Y, 28M, 28C, and 28K.

A photoconductive drum 30 rotated in a predetermined direction (in FIG. 1, counterclockwise) is provided in each of the process cartridges 28Y, 28M, 28C, and 28K. Around the photoconductive drum 30, there are provided, from the upstream side of the rotational direction of the photoconductive drum 30, a charging roller 32 as a charging device which uniformly charges the photoconductive drum 30, an exposure device 34 which exposes the charged photoconductive drum 30 to form an electrostatic latent image on the photoconductive drum 30, a developing roller 36 as a developing device which adheres toner in each of the colors onto the electrostatic latent image formed on the photoconductive drum 30 for development, an electricity removing brush 37 as an electricity removing device which removes electricity from the photoconductive drum 30 subjected to transfer, and a cleaning blade 38 as a cleaning device which removes the toner remaining on the surface of the photoconductive drum 30 from which electricity is removed. The toner removed from the surface of the photoconductive drum 30 by the cleaning blade 38 is transported to one side by an auger 35 and is then discharged to a toner collecting box, not illustrated.

The charging roller 32 and the developing roller 36 are provided in each of the process cartridges 28Y, 28M, 28C, and 28K. Although not illustrated, the process cartridges 28Y, 28M, 28C, and 28K is detachable in the left direction (the front side of the apparatus).

Specifically, a semiconductor laser (not illustrated), a polygon mirror 52, a focusing lens 54, and a mirror 56 are disposed in a housing 50 of the exposure device 34. A light from the semiconductor laser is deflected and scanned by the polygon mirror 52 and illuminates the photoconductive drum 30 via the focusing lens 54 and the mirror 56. An electrostatic latent image according to image information is formed on the photoconductive drum 30.

On the inner circumferential side of the transporting belt 26 in front of the photoconductive drum 30, a transfer device 39 which transfers the toner image formed on the photoconductive drum 30 onto the sheet P in a predetermined transfer position.

On the downstream side of the image forming transporting path 86 (simply called a "downstream side"), the fixing device 60 as a fixing unit which fixes the transferred toner image onto the sheet P. The fixing device 60 has a heating roller 62 (an example of one of transporting members), and a pressure roller 64 pressed onto the heating roller 62 (an example of the other transporting member). The sheet P passes through a nip portion 66 formed between the heating roller 62 and the pressure roller 64 to fix the toner image transferred by melting the toner on the sheet P (or the unfixed toner image).

The image forming apparatus 10 has a first sheet transporting path 88 (an example of a first transporting path) which guides the sheet P subjected to the fixing process by the fixing device 60 to a discharge port 40. The discharge port 40 has a discharge roller 42 (an example of a discharge member) rotated with a driving motor 41 which can be rotated forward or reversely as a driving source, and a pressing roller 44 pressed into contact with the lower portion side of the discharge roller 42. The pressing roller 44 is pressed into contact with the discharge roller 42 by a biasing force of a spring 46 (see FIG. 5) provided below the pressing roller 44 and is rotated so as to follow the discharge roller 42. At the completion of printing (image formation), the sheet P passes through the first sheet transporting path 88 and is nipped and transported by the discharge roller 42 and the pressing roller 44 so as to be discharged from the discharge port 40 to the discharge section 20.

A sheet sensor, not illustrated, is provided before the discharge port 40 and detects the presence or absence of the sheet P in the discharge port 40.

For duplex printing, the sheet P with one side on which an image is formed is nipped and transported by the discharge roller 42 and the pressing roller 44. The discharge roller 42 is then reversely rotated (specifically, the driving motor is reversely rotated) when the leading edge of the sheet P is discharged from the discharge port 40 to the outside. The sheet P is returned, starting from its trailing edge, to a later-described second sheet transporting path 90 (an example of a second transporting path). The discharge roller 42 is reversely rotated when the detection of the sheet P by the sheet sensor is changed from presence to absence. The timing of the reverse rotation of the discharge roller is not limited to this configuration. The discharge roller may be reversely rotated according to the size and transporting speed of the sheet P transported.

The second sheet transporting path 90 is provided so as to pass above the first sheet transporting path 88 and to pass leftwardly (or the front side of the apparatus) of the image forming transporting path 86.

Plural (e.g., two) pairs of transporting rollers 48 which nip and transport the sheet P downward are arranged on the second sheet transporting path 90. For duplex printing, the sheet P with one side on which an image is formed is guided to the second sheet transporting path 90, is transported downward by the plural transporting rollers 48, and is returned to the registration rollers 24.

The fixing device 60 will be specifically described. The fixing device 60 has a housing, not illustrated. The heating roller 62, the pressure roller 64, the discharge roller 42, and the pressing roller 44, and the spring 46 are attached to the housing. There are attached, to the housing, a separating guide 70 which separates the sheet P subjected to heating and fixing from the heating roller 62 and a paper shoot 200 as an opening/closing transporting path member configuring the first sheet transporting path 88 and the second sheet transporting path 90 (see FIG. 2). A cover 300 (an example of a cover) which covers the discharge roller 42 is provided above the discharge roller 42 in the housing of the fixing device 60.

Figure 2:
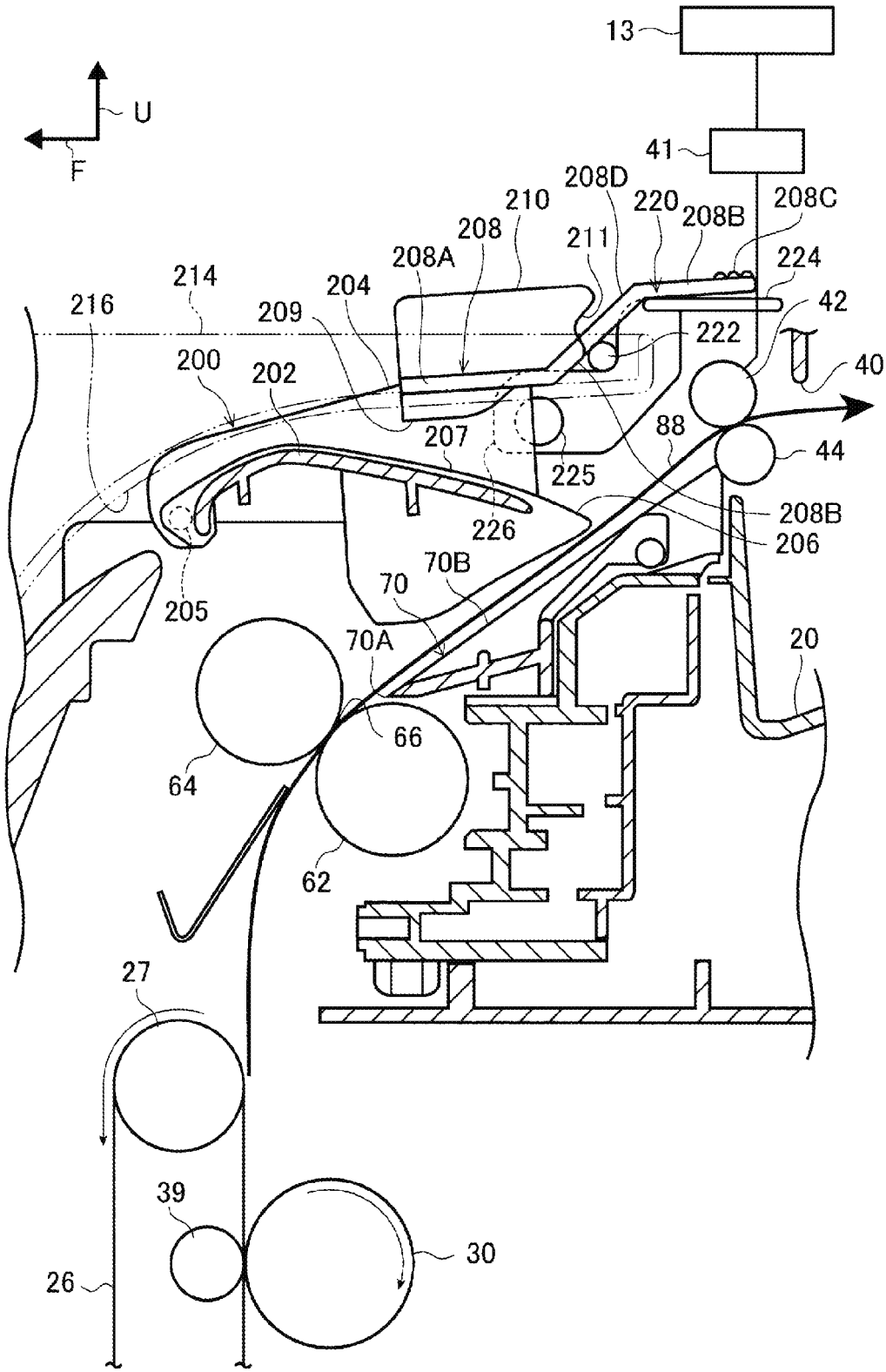
FIG. 2 is a cross-sectional view illustrating a state which enables passage through a first sheet transporting path of the image forming apparatus of the first exemplary embodiment.

As illustrated in FIG. 2, the separating guide 70 is arranged above the heating roller 62 and is substantially triangular as seen in a side view. A tip end 70A of the separating guide 70 is close to the heating roller 62 and separates the sheet P subjected to heating and fixing from the heating roller 62. One surface (or the surface on the front side of the apparatus) of the separating guide 70 forms a transporting path surface 70B of the first sheet transporting path 88. Plural ribs 72 extended along the first sheet transporting path 88 are arranged side by side in an axial direction of the heating roller 62 on the transporting path surface 70B (see FIG. 5).

As illustrated in FIG. 2, the paper shoot 200 has a curved core material 202. Side walls 204 are provided at both ends of the core material 202 in an axial direction. A rotating shaft 205 rotatably supporting each of the side walls 204 in the housing is provided at one end (in the drawing, the left end) of the side wall 204. The paper shoot 200 is rotated to access the heating roller 62 and the pressure roller 64 of the fixing device 60. Plural ribs 206 having a substantially triangular shape as seen in a side view are arranged side by side in an axial direction (or an axial direction of the rotating shaft 205) on the core material 202 and cover the heating roller 62 and the pressure roller 64. The ribs 206 located on the upper surface of the core material 202 are a transporting path surface 207 of the second sheet transporting path 90. Therefore, The contact area of the sheet P passing through the second sheet transporting path 90 and the transporting path surface 207 of the paper shoot 200 is reduced and frictional resistance is reduced and the sheet P smoothly flows through the second sheet transporting path 90.

Figure 3:
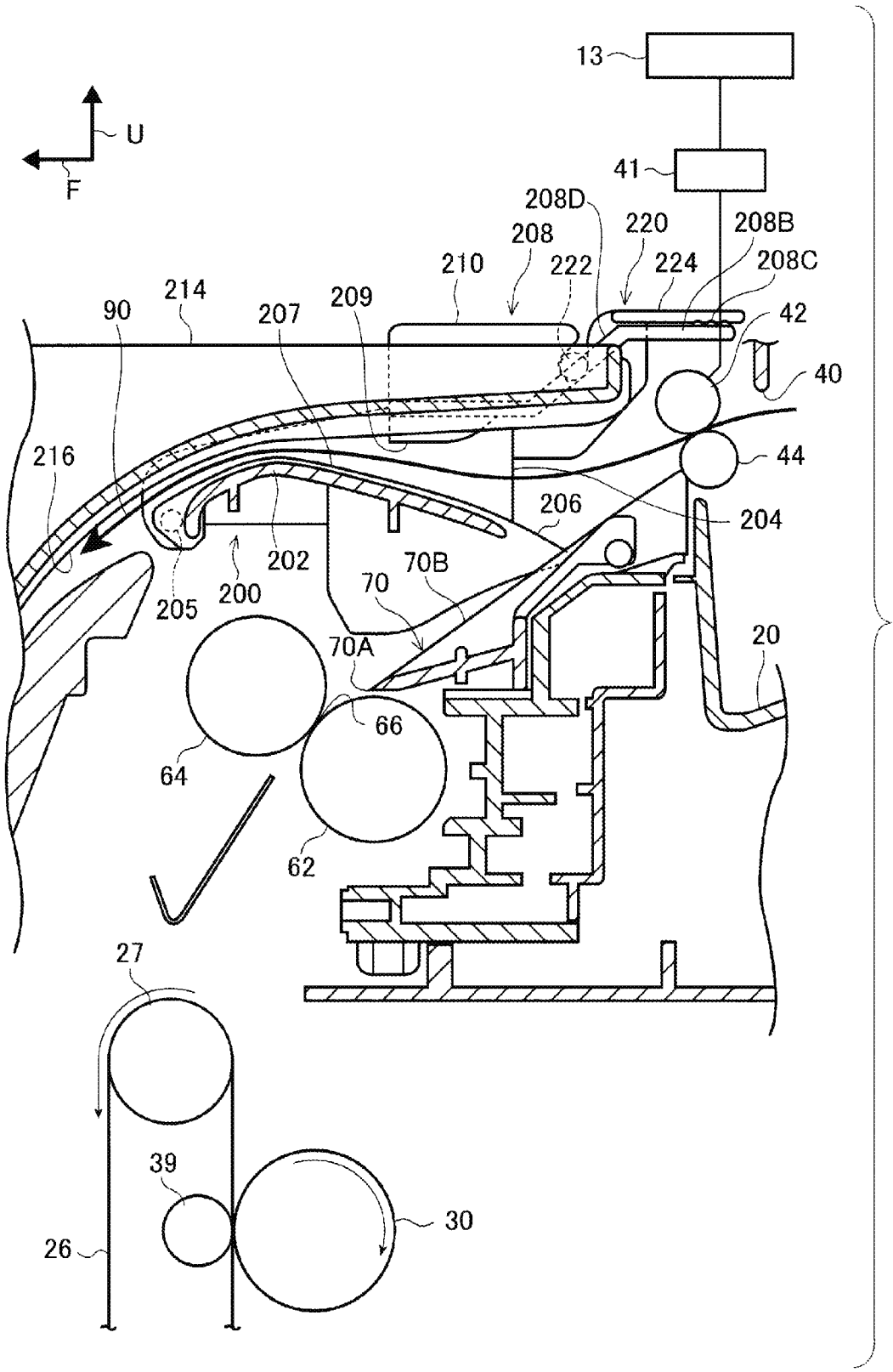
FIG. 3 is a cross-sectional view illustrating a state which enables passage through a second sheet transporting path of the image forming apparatus of the first exemplary embodiment.

When there is no sheet P on the first sheet transporting path 88, as illustrated in FIG. 3, the ends of the ribs 206 enter into between the ribs 72 of the separating guide 70 by their own weight in the paper shoot 200. When the sheet P is transported from the nip portion 66 between the heating roller 62 and the pressure roller 64, the ends of the ribs 206 of the paper shoot 200 are pushed up by the transported sheet P and the sheet P passes through the first sheet transporting path 88 and is then transported to the discharge port 40. When the sheet P is reversed, the discharge roller 42 is reversely rotated to return the sheet P onto the transporting path surface 207 of the paper shoot 200.

Figure 5:
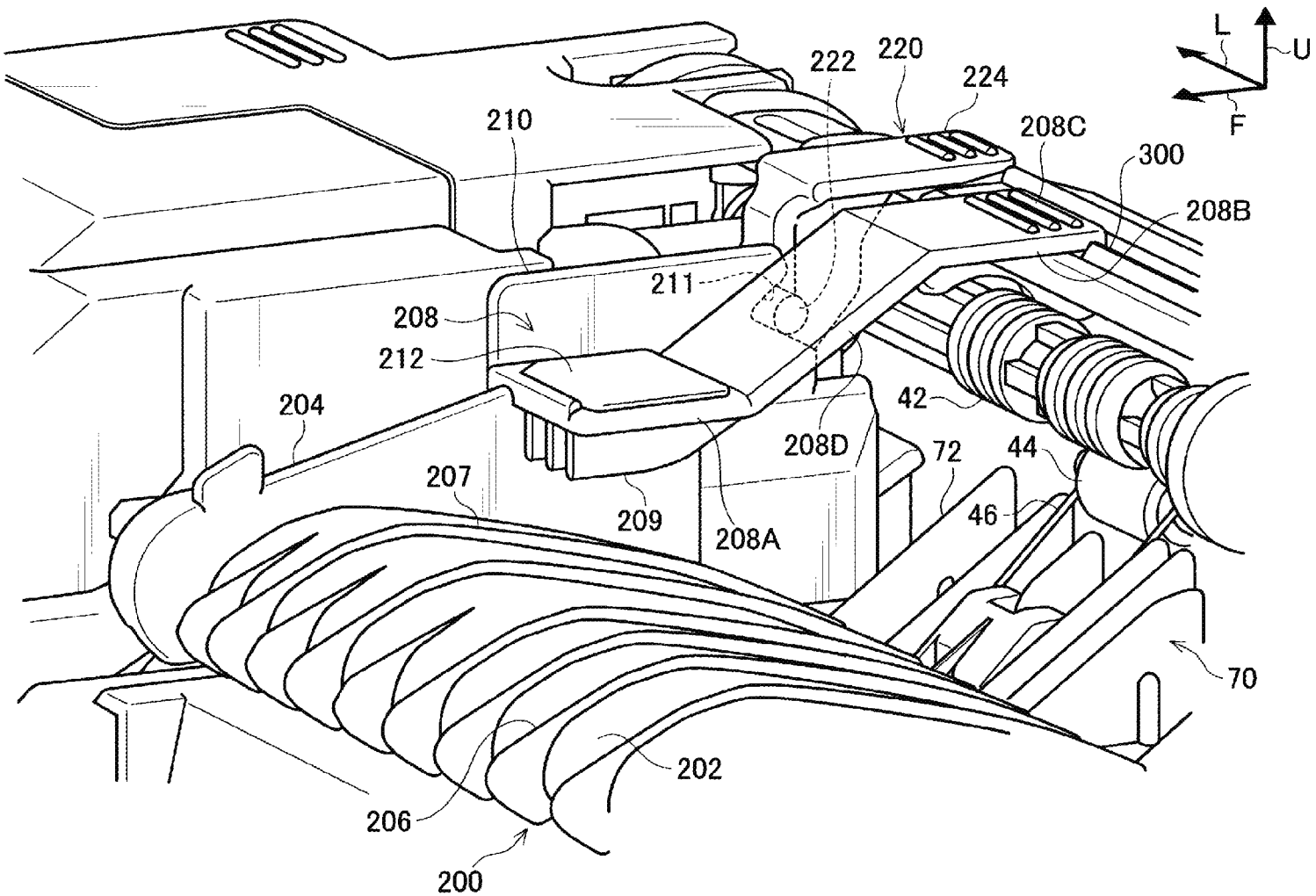
FIG. 5 is an enlarged perspective view of an opening/closing transporting path member in the state of opening the transporting path member of the image forming apparatus of the first exemplary embodiment as seen diagonally from top.

As illustrated in FIG. 5, a handle 208 is provided on one of the side walls 204 of the paper shoot 200 so as to be extended to the transporting path surface 207. The handle 208 has a planar portion 208A which is flat as seen in a plan view, an inclined portion 208D inclined upward from the planar portion 208A, and a holding portion 208B extended from the end of the inclined portion 208D above the cover 300 and close to the cover 300. The handle 208 is integrally formed with the paper shoot 200. Plural ribs 209 extended along the second sheet transporting path 90 are provided side by side in an axial direction on the lower surface of the handle 208 (in this exemplary embodiment, the lower surface of the planar portion 208A). The ribs 209 are projected toward the second sheet transporting path 90 side from the ribs 216 of a later-described duplex unit 214.

A side plate 210 is erected on the side portion of the handle 208. A projection 222 of a later-described nip releasing lever 220 (an example of a separating mechanism) is brought into contact with an inclined surface 211 formed at the end of the side plate 210.

An irregular portion (concavo-convex portion) 208C (in this exemplary embodiment, a knurled irregular portion) is formed on the upper surface of the holding portion 208B to prevent the slip of the holding portion 208B. An operating label 212 is stuck onto the upper surface of the planar portion 208A of the handle 208 in order to improve the visibility of the handle 208.

Figure 4:
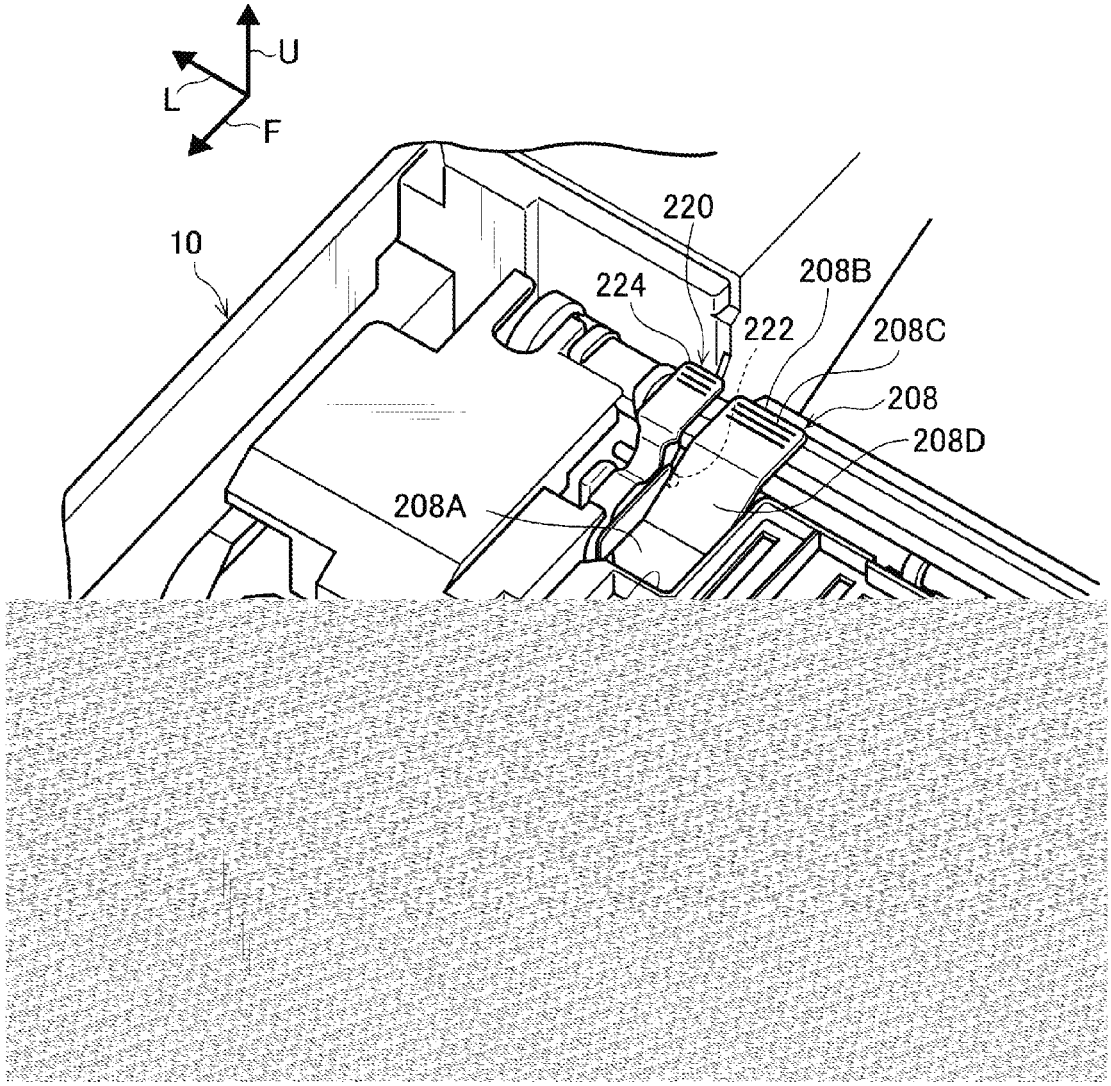
FIG. 4 is a partial sectional perspective view of a transporting path member of the image forming apparatus of the first exemplary embodiment as seen diagonally from top.

As illustrated in FIGS. 3 and 4, the duplex unit 214 (an example of a transporting path member) is arranged above the paper shoot 200 so as to face the paper shoot 200. The duplex unit 214 is rotatably supported with respect to the image forming apparatus 10, and has a substantially L-shape seen in an axial direction. The duplex unit 214 covers the paper shoot 200 during the use of the image forming apparatus 10, and forms the second sheet transporting path 90 between the duplex unit 214 and the paper shoot 200.

Plural ribs 216 extended along the second sheet transporting path 90 are provided side by side in an axial direction on a back surface 214A of the duplex unit 214.

A rectangular cut-away portion 218 which accommodates at least the holding portion 208B of the handle 208 is provided in the duplex unit 214. The cut-away portion 218 is provided in a corner portion at the end of the duplex unit 214. In the state in which the holding portion 208B is accommodated in the duplex unit 214, the ribs 209 are projected further toward the second sheet transporting path 90 than the ribs 216 of the duplex unit 214. Therefore, at duplex printing, the trailing edge of the sheet P returned from the discharge port 40 to the second sheet transporting path 90 is hard to engage the step of the ribs 209 and 216.

Figure 6B:
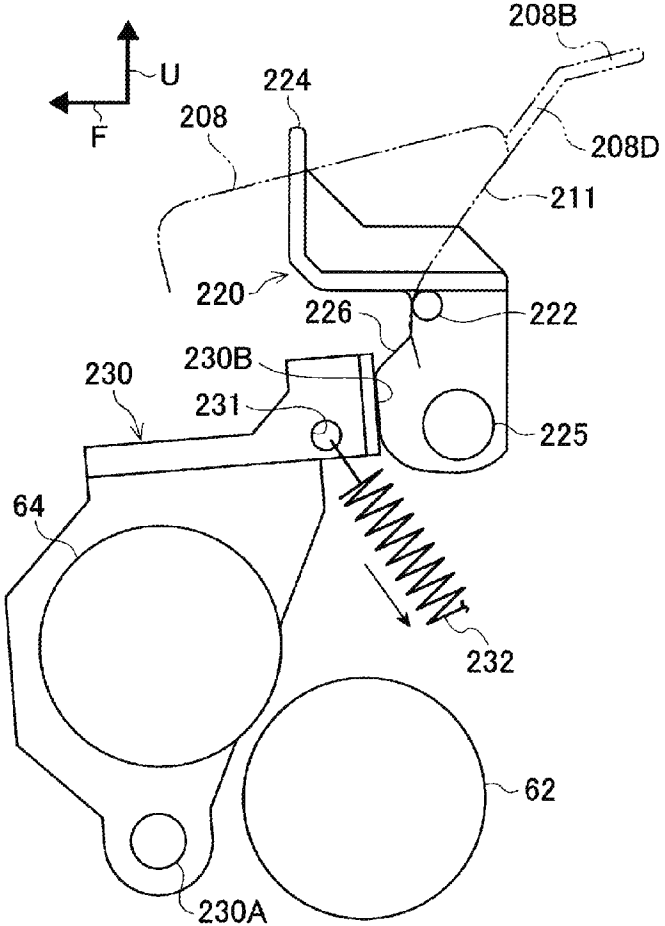
FIG. 6A is a partial sectional view illustrating the state of the pressure contact of a heating roller and a pressure roller by closing a nip releasing lever of the first exemplary embodiment and FIG. 6B is a partial sectional view illustrating the state of releasing the pressure contact of the heating roller and the pressure roller by opening the nip releasing lever of the first exemplary embodiment.
Figure 6A:
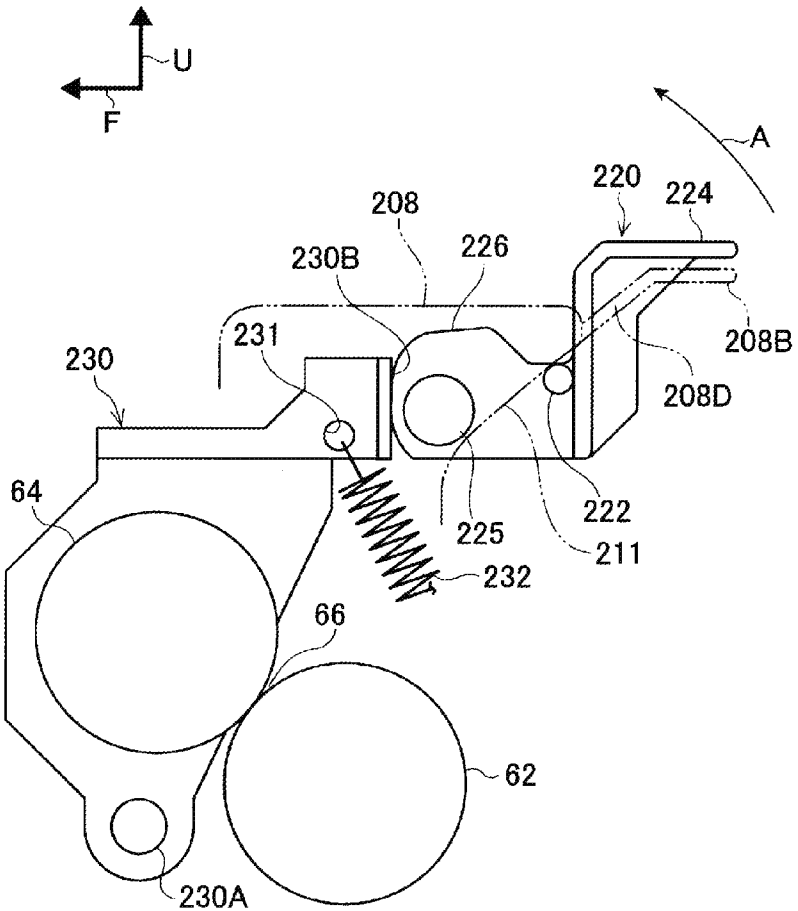

As illustrated in FIG. 6A, a pair of supporting members 230 which rotatably support the pressure roller 64 are provided at both ends of the pressure roller 64. The supporting member 230 has a rotating shaft 230A diagonally down to the left from the rotating shaft of the pressure roller 64 and is rotatably supported in the housing via the rotating shaft 230A. A throughhole 231 is provided diagonally up to the right of the supporting member 230. One end of a spring 232 is fitted into the throughhole 231. The spring 232 has the other end attached to the housing and is biased in the direction pressing the pressure roller 64 into contact with the heating roller 62.

As illustrated in FIGS. 5 and 6A, the nip releasing lever 220 is provided in the housing so as to be adjacent to the handle 208. The nip releasing lever 220 is attached to the housing so as to be rotatable by the rotating shaft 225, and has, on its side surface, the cylindrical projection 222 projected in an axial direction. The circumferential surface of the projection 222 is brought into contact with the inclined surface 211 of the side plate 210.

As illustrated in FIG. 6A, the nip releasing lever 220 has a lever portion 224 to be held by the user rightwardly of the rotating shaft 225, and an extending portion 226 brought into contact with a rear end 230B (in the drawing, the right end) of the supporting member 230 leftwardly of the rotating shaft 225. The extending portion 226 has a cam shape in which the distance from the rotating shaft 225 is increased from the left end to the upper end. When the nip releasing lever 220 is rotated in an arrow A direction, the extending portion 226 presses the rear end 230B of the supporting member 230 leftward. The supporting member 230 in which the rear end 230B is pressed is rotated counterclockwise about the rotating shaft 230A. Therefore, the spring 232 is extended to release the nip between the pressure roller 64 and the heating roller 62.

As illustrated in FIG. 6B, when the nip releasing lever 220 is rotated approximately 90 degrees in the arrow A direction, the projection 222 is moved from a first position (the projection position of FIG. 6A) to a second position (the projection position of FIG. 6B). When the projection 222 is moved from the first position to the second position, the moving projection 222 raises the handle 208 along the inclined surface 211 of the paper shoot 200 to move the holding portion 208B in the direction separating from the cover 300. At this time, the ends of the ribs 206 of the paper shoot 200 are raised together with the handle 208. Therefore, the paper shoot 200 is opened to visually check the portion in which the nip between the pressure roller 64 and the heating roller 62 is released.

The operation of this exemplary embodiment will be described with reference to FIG. 7.

Figure 7:
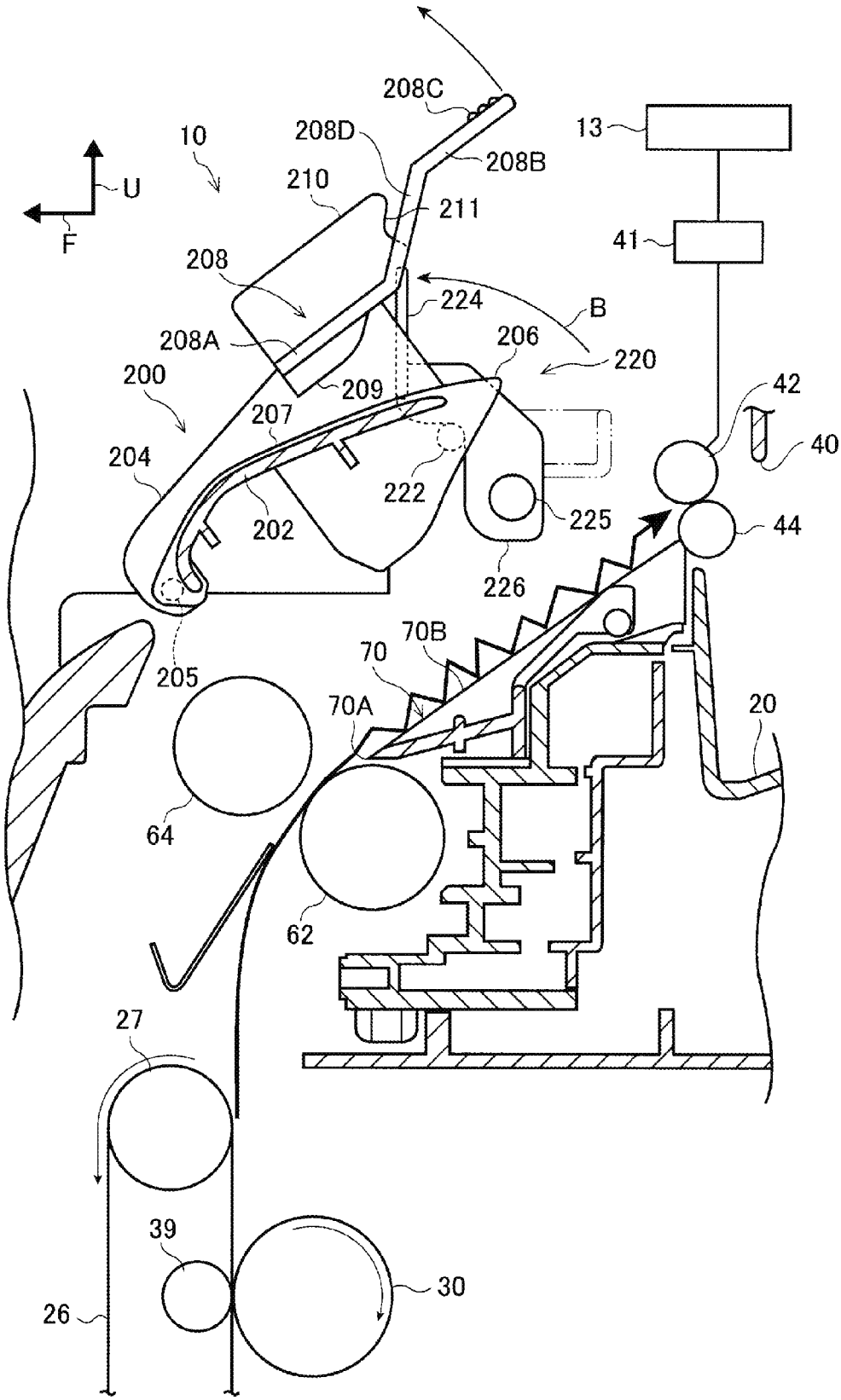
FIG. 7 is a cross-sectional view illustrating the state of opening the opening/closing transporting path member of the image forming apparatus of the first exemplary embodiment.

As illustrated in FIG. 7, when the sheet P is jammed and the nip between the heating roller 62 and the pressure roller 64 need to be released, a cover 10A of the image forming apparatus 10 is opened to open the duplex unit 214 together with the cover 10A.

The lever portion 224 of the nip releasing lever 220 is held and is rotated counterclockwise (in the arrow A direction of FIG. 6A). Therefore, the supporting member 230 is rotated about the rotating shaft 230A. With this, the pressure roller 64 is moved in the direction separating from the heating roller 62 to release the pressure contact of the pressure roller 64 with the heating roller 62. At this time, the handle 208 is raised by the projection 222 moving from the first position to the second position. Therefore, the handle 208 is easily visually checked and held.

The holding portion 208B of the handle 208 is held to rotate the paper shoot 200 in an arrow B direction. Therefore, the first sheet transporting path 88 is opened to easily remove the jammed sheet P from the portion in which the pressure contact of the heating roller 62 and the pressure roller 64 is released. That is, as in this exemplary embodiment, before the pressure contact of the heating roller 62 and the pressure roller 64 is released by the nip releasing lever 220, the holding portion 208B of the handle 208 is hard to be held. This may prevent the user who forgets to release the pressure contact of the heating roller 62 and the pressure roller 64 from opening the paper shoot and forcefully removing the jammed sheet P. That is, when the nip between the heating roller 62 and the pressure roller 64 is released to remove the jammed sheet P, an operating procedure is defined so that the user does not forget to separate the heating roller 62 and the pressure roller 64. Even though the handle 208 is heated by heat from the heating roller 62, after the nip releasing lever 220 is rotated, the open shoot 200 is opened by holding the holding portion 208B of the handle 208 raised from the cover 300. Therefore, as compared with the case that the holding portion of the handle is directly held without rotating the nip releasing lever 220, the temperature of the holding portion 208B is lowered.

Figure 8:
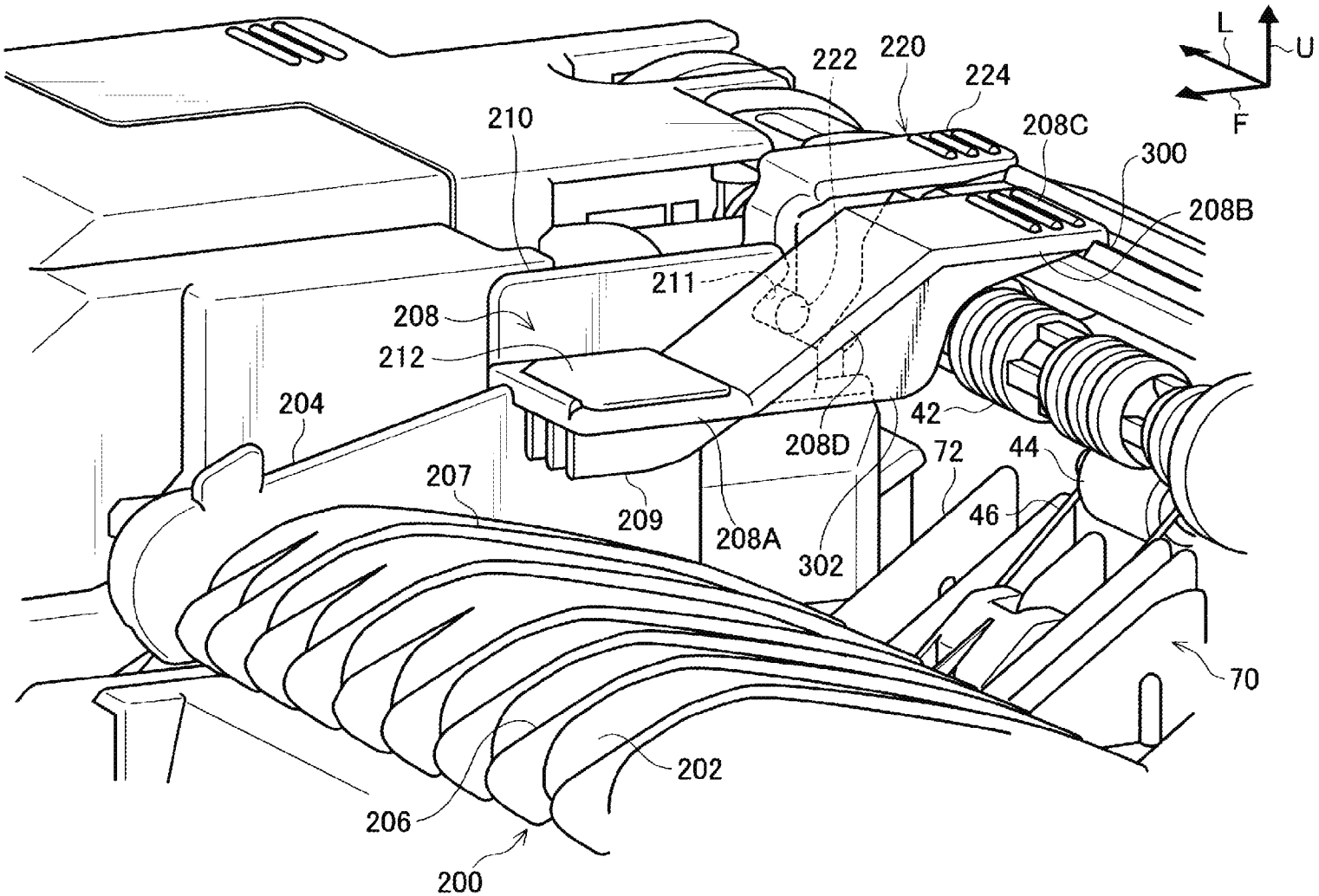
FIG. 8 is an enlarged perspective view illustrating a modification of a handle of the opening/closing transporting path member of the first exemplary embodiment and the opening/closing transporting path member in the state of opening the transporting path member as seen diagonally from top.

In the above exemplary embodiment, the handle 208 has the planar portion 208A, the inclined portion 208D, the holding portion 208B, and the irregular portion 208C. However, the invention need not be limited to this configuration. As illustrated in FIG. 8, a wall portion 302 extended toward the first sheet transporting path 88 side is provided on the inner side surface of the first sheet transporting path 88 of the inclined portion 208D and the holding portion 208B of the handle 208. The holding and rotation of the holding portion 208B of the handle 208 may be prevented before the nip releasing lever 220 is rotated.

In the above exemplary embodiments, the handle 208 is formed on the paper shoot 200. However, the invention need not be limited to this configuration. The handle may be provided by applying the transporting path configuration of the invention to any member forming the transporting path (transporting path member).

The exemplary embodiments of the invention have been described above. However, these exemplary embodiments are an example and various modifications may be made and executed within the scope without departing from the purport. Needless to say, the scope of the claims of the invention is not limited to these exemplary embodiments.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transporting path configuration comprising:

a separating mechanism that, with respect to a pair of transporting members which nip and transport a recording medium, separates from one of the transporting members the other transporting member;

an opening/closing transporting path member that is rotatably attached above the transporting members and has a first surface that configures a first transporting path of the recording medium discharged from the transporting members;

a transporting path member that is rotatably attached above the opening/closing transporting path member and forms a second transporting path between the transporting path member and a second surface of the opening/closing transporting path member in a state of covering the opening/closing transporting path member; and a handle that is attached to the opening/closing transporting path member so as to be extended above the second transporting path and is further extended above a cover that covers a discharge member that transports the recording medium transported from the first transporting path;

wherein the separating mechanism moves the handle in a direction away from the cover when the other transporting member is separated from the one transporting member by the separating mechanism.

2. The transporting path configuration of claim 1, wherein the separating mechanism has a projection that is moved from a first position to a second position when the other transporting member is separated from the one transporting member, the handle has an inclined surface brought into contact with the projection, and the inclined surface is inclined so as to move the handle in the direction away from the cover when the projection is moved from the first position to the second position.

3. The transporting path configuration of claim 1, wherein the handle has a projected wall that guides the recording medium passing through the second transporting path on a surface thereof facing the second surface of the opening/closing transporting path member.

4. The transporting path configuration of claim 1, wherein the transporting path member has a cut-away portion which accommodates at least part of the handle.

5. The transporting path configuration of claim 1, wherein the handle has a concavo-convex portion on an upper surface of a holding portion thereof.

6. The transporting path configuration of claim 1, wherein the one transporting member includes a heating member which heats the recording medium onto which a developer image has been transferred, and the other transporting member includes a pressing member that presses the recording medium onto the heating member.

7. The transporting path configuration of claim 1, wherein the handle is integrally formed with the transporting path member.

8. An image forming apparatus comprising:

the transporting path configuration of claim 1;

an image forming unit that transfers a developer image onto the recording medium;

a fixing unit that fixes the developer image transferred onto the recording medium; and a recording medium reversing unit that returns the recording medium that has passed from the fixing unit through the first transporting path with a leading edge of the recording medium passing through the discharge member, starting from a trailing edge of the recording medium, to the second transporting path by reversely rotating the discharge member at a predetermined timing.

* * * * *